US008456500B2

(12) United States Patent
Kitamura

(10) Patent No.: US 8,456,500 B2
(45) Date of Patent: Jun. 4, 2013

(54) PRINTING APPARATUS AND METHOD FOR CONTROLLING PRINTING APPARATUS

(75) Inventor: Gen Kitamura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 328 days.

(21) Appl. No.: 12/908,887

(22) Filed: Oct. 21, 2010

(65) Prior Publication Data

US 2011/0122214 A1 May 26, 2011

(30) Foreign Application Priority Data

Nov. 24, 2009 (JP) ..... 2009-266114

(51) Int. Cl.
*B41J 2/325* (2006.01)

(52) U.S. Cl.
USPC ..... 347/213

(58) Field of Classification Search
USPC ..... 347/171–174, 176–178, 197, 198, 347/212–216, 222, 120.01, 120.02, 120.04, 347/120.16, 120.17
See application file for complete search history.

(56) References Cited

U.S. PATENT DOCUMENTS

| | | | | |
|---|---|---|---|---|
| 5,978,005 | A * | 11/1999 | Hadley | 347/177 |
| 6,071,024 | A * | 6/2000 | Chi-Ming et al. | 400/120.02 |
| 6,493,017 | B1 * | 12/2002 | Huang | 347/178 |
| 6,509,920 | B2 * | 1/2003 | Sung et al. | 347/178 |
| 7,277,109 | B2 * | 10/2007 | Ueda | 347/177 |
| 7,397,489 | B2 * | 7/2008 | Mindler et al. | 347/176 |
| 7,474,323 | B2 * | 1/2009 | Sawada et al. | 347/213 |
| 7,717,632 | B2 * | 5/2010 | Lien et al. | 400/120.17 |

FOREIGN PATENT DOCUMENTS

| | | | |
|---|---|---|---|
| CN | 1504729 | A | 6/2004 |
| CN | 1775536 | A | 5/2006 |
| CN | 1807106 | A | 7/2006 |
| JP | 59-9077 | A | 1/1984 |
| JP | 9-188048 | A | 7/1997 |
| JP | 2006-159432 | A | 6/2006 |
| JP | 2006-263919 | A | 10/2006 |
| JP | 2007-076803 | A | 3/2007 |
| JP | 2007-196454 | A | 8/2007 |

* cited by examiner

*Primary Examiner* — Kristal Feggins
(74) *Attorney, Agent, or Firm* — Canon USA Inc. IP Division

(57) ABSTRACT

A printing apparatus including a head holding unit movably configured to hold a thermal head so that the thermal head can be in a pressing state pressing against a platen and in a separated state separated from the platen, a conveyance mechanism configured to convey an ink ribbon and a recording sheet which are put on each other to a recording region between the thermal head and the platen, a reflection surface provided on the head holding unit, and a ribbon sensor configured to detect a marker applied on the ink ribbon, the ribbon sensor being provided on an opposite side to the reflection surface across a path of the ink ribbon which has passed through the recording region and been peeled from the recording sheet. The ribbon sensor includes a light emitting element and a light receiving element. The reflection surface is configured so that light incident from the light emitting element reaches the light receiving element in both the separated state and the pressing state.

11 Claims, 11 Drawing Sheets

PRINTING APPARATUS AND METHOD FOR CONTROLLING PRINTING APPARATUS

BACKGROUND OF THE INVENTION

1. Field of the Invention

The present invention relates to a printing apparatus, and more specifically, to a thermal transfer type printing apparatus which includes a unit for detecting a marker on an ink ribbon.

2. Description of the Related Art

Examples of printer printing methods include thermal transfer, in which ink coated on an ink ribbon is thermally transferred onto printing paper using a thermal head. Examples of a thermal printer, which is a printing apparatus that employs a thermal transfer technique, include printers having a unit for detecting a conveyance position on the ink ribbon.

A method in which a thermal printer detects the conveyance position of an ink ribbon will be described using FIGS. 7 to 11. FIG. 7 is a cross-sectional view of a printing mechanism vicinity in a conventional thermal printer.

A thermal head 101 is fixedly supported on a thermal head unit 150. The thermal head unit 150 is rotatable around a not-illustrated rotation center, and is supported on a main frame of the apparatus body. A platen roller 102 is rotatably supported so as to face a heating element provided on the thermal head 101. The thermal head 101 presses against and separates away from the platen roller 102 according to rotation of the thermal head unit 150.

The thermal head unit 150 is rotated along with the rotation of a head drive lever 110. Control of the rotation amount of the head drive lever 110 is performed by controlling a head drive motor 130 via a not-illustrated drive system.

When a printing operation starts, the head drive lever 110 is rotatably driven a predetermined amount, and the thermal head 101 illustrated in FIG. 7 is moved to a separated state separated from the platen roller 102.

Next, an ink ribbon 105 is wound to perform head-finding conveyance of the ink ribbon, and the head color region (the region onto which the ink of the color to be transferred first is coated) of the ink ribbon 105 is positioned immediately below the thermal head 101.

Next, a pair of conveyance rollers 103 is rotated in a state in which they sandwich a sheet of printing paper 104, and the printing paper 104 is conveyed to a printing start position. Consequently, printing preparation onto the printing paper 104 is completed. The driving of the pair of conveyance rollers 103 and the winding of the ink ribbon 105 are respectively performed by the same conveyance motor 131 via a not-illustrated drive system.

Here, head-finding conveyance of the ink ribbon will be described. FIG. 8 illustrates a partial region of a typical ink ribbon 105. Various colors of ink, for example yellow, magenta, cyan, and an overcoat, are coated on the ink ribbon 105. Between adjacent ones of the regions on which the various ink colors are coated, a light-impermeable black marker 120 is applied.

In the separated state illustrated in FIG. 7, generally, the light emitted from a photoreflector 106 is reflected by a refection plate 107 attached to the thermal head unit 150, and reaches a light reception unit of the photoreflector 106. However, if the black marker 120 coated on the ink ribbon 105 passes above this light path, the light is blocked, and does not reach the light reception unit of the photoreflector 106. Consequently, the black marker 120 can be detected.

Further, as illustrated in FIG. 8, before the ink of the first color (in FIG. 8, yellow) is transferred for the first time during printing, two black markers 120 are printed. Consequently, the head of the ink for the first color and the head of the inks for the other colors can be distinguished. Therefore, when the second black marker 120 is detected as being positioned above the light path of the light from the photoreflector 106, conveyance of the ink ribbon 105 is stopped, and the head-finding conveyance of the ink ribbon is completed.

When the head-finding of the ink ribbon and the head-finding conveyance of the printing paper are completed, the head drive lever 110 is rotatably driven by a predetermined amount. Consequently, as illustrated in FIG. 9, the thermal head 101 moves to a pressing state in which it presses against the platen roller 102. Then, the thermal head 101 selectively causes each heating element to generate heat based on an input image. Along with this, while the pair of conveyance rollers 103 conveys the printing paper 104 in a conveyance direction during printing, a ribbon winding mechanism conveys the ink ribbon 105. Consequently, the ink on the ink ribbon 105 is transferred onto the printing paper 104, whereby a yellow image is formed on the printing paper 104.

Although the ink ribbon 105 which underwent ink transfer is stuck to the printing paper 104 due to heat, the ink ribbon 105 is peeled from the printing paper 104 by conveying it in a different direction from the conveyance direction of the printing paper with a leading edge of a peeling member 108 acting as a starting point.

FIG. 10 illustrates the state when the formation of the yellow image is finished. When image formation is finished, the heat generation from a heating element 151 of the thermal head 101 is stopped. At this stage, the printing paper 104 and the ink ribbon 105 are stuck to each other over a distance A from the heating element 151 to the leading edge of the peeling member 108 (the starting point where the printing paper and the ink ribbon peel from each other). Consequently, while the thermal head 101 is separating from the platen roller 102 (is in the separated state), the printing paper 104 and the ink ribbon 105 are conveyed, and a peeling operation which peels the printing paper 104 and the ink ribbon 105 from each other is actively performed. When the printing paper 104 and the ink ribbon 105 have been sufficiently conveyed and peeled from each other, driving of the conveyance motor 131 is stopped, and the peeling operation is completed.

Next, the ink ribbon 105 is conveyed to the head of the ink for the next color (magenta), and the printing paper 104 is returned to the printing start position. Then, the thermal head 101 is pressed against the platen roller 102 (is in the pressing state), and a printing operation is performed with the ink for the next color.

By repeating this operation, a magenta image and a cyan image are superimposed over the yellow image to form the desired full color image.

FIG. 11 illustrates a positional relationship between the position of the marker 120 printed on the ink ribbon 105 and a region (transfer region R) onto which the ink for each color is applied and which receives the generated heat from the head.

A margin B is provided between the trailing edge of the marker 120 applied on the head of the ink for each color and the leading edge of the transfer region of the ink for the next color. The length of this margin B is illustrated in FIG. 10. This length corresponds to a distance D between the position where the light from the photoreflector 106 reaches and the position of the heating element 151. To perform head-finding of the ink ribbon 105, the leading edge of the transfer region R of the ink ribbon needs to be positioned where the heating element 151 of the thermal head is located at the point when the photoreflector 106 has detected the marker 120.

Further, a margin C is also provided between the trailing edge of the transfer region R and the leading edge of the marker 120 provided at the head of the ink for the next color. This margin C is set to be longer than a length calculated by subtracting the length of the margin B from the conveyance distance of the ink ribbon 105 during the peeling operation. Because of this margin C, after the peeling operation is completed, the photoreflector 106 can detect the marker 120 on the ink ribbon.

If this margin C is not provided, when the peeling operation is completed, the marker 120 at the head of the ink for the next color passes by the light path of the light output from the photoreflector 106. Consequently, after the peeling operation is completed, the marker 120 cannot be detected while the ink ribbon 105 is being conveyed even if an attempt is made to do so. Thus, head-finding of the ink for the next color cannot be performed.

Therefore, for conventional head-finding conveyance of an ink ribbon, it is necessary to form wasteful margins B and C, which cannot be used as the transfer region R. Such margins B and C increase the total length of the ink ribbon 105, leading to an increase in the size of the ink ribbon cassette and in increase in costs. Further, during printing, the ink ribbon 105 has to be needlessly conveyed by the additional length of the margins B and C of the ink ribbon, which increases the time taken for printing.

Further, because the ink ribbon 105 is conveyed more than necessary, the opportunity for wrinkles to form on the ink ribbon 105 increases. The pattern of these wrinkles is printed on the printing paper, which also leads to the problem of an increased risk of the printing quality deteriorating.

In view of the above-described problems, for example, Japanese Patent Application Laid-Open No. 2006-159432 discusses a sensor for detecting a marker on an ink ribbon, which is located between the heating element of the thermal head and a peeling starting point of the peeling member. Light from the sensor is irradiated on the ink ribbon located between the heating element and the peeling member. In this case, since the distance between the position where the light from the sensor is irradiated and the position of the heating element is shortened, the margin B between the marker and the transfer region R of the ink for the next color can be shortened.

In the technique discussed in Japanese Patent Application Laid-Open No. 2006-159432, the light from the sensor irradiates a portion where the ink ribbon and the printing paper are stuck together. Consequently, to detect the marker on the ink ribbon, the sensor light is reflected by the surface of the printing paper. In this case, if the printing paper jiggles around or curls in the printer, the light path of the reflected light reflected by the printing paper diffuses. Therefore, there is the problem that the ink ribbon marker cannot be correctly detected.

SUMMARY OF THE INVENTION

The present invention is directed to a printing apparatus which can stably detect the head of an ink ribbon, and can reduce an ink ribbon margin.

According to an aspect of the present invention, a printing apparatus includes a head holding unit movably configured to hold a thermal head so that the thermal head can be in a pressing state pressing against a platen and in a separated state separated from the platen, a conveyance mechanism configured to convey an ink ribbon and a recording sheet which are put on each other to a recording region between the thermal head and the platen, a reflection surface provided on the head holding unit, and a ribbon sensor configured to detect a marker applied on the ink ribbon, the ribbon sensor being provided on a side opposite to the reflection surface and facing a path of the ink ribbon which has passed through the recording region and been peeled from the recording sheet, wherein the ribbon sensor includes a light emitting element and a light receiving element, and wherein the reflection surface is configured so that light incident from the light emitting element reaches the light receiving element in both the separated state and the pressing state.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
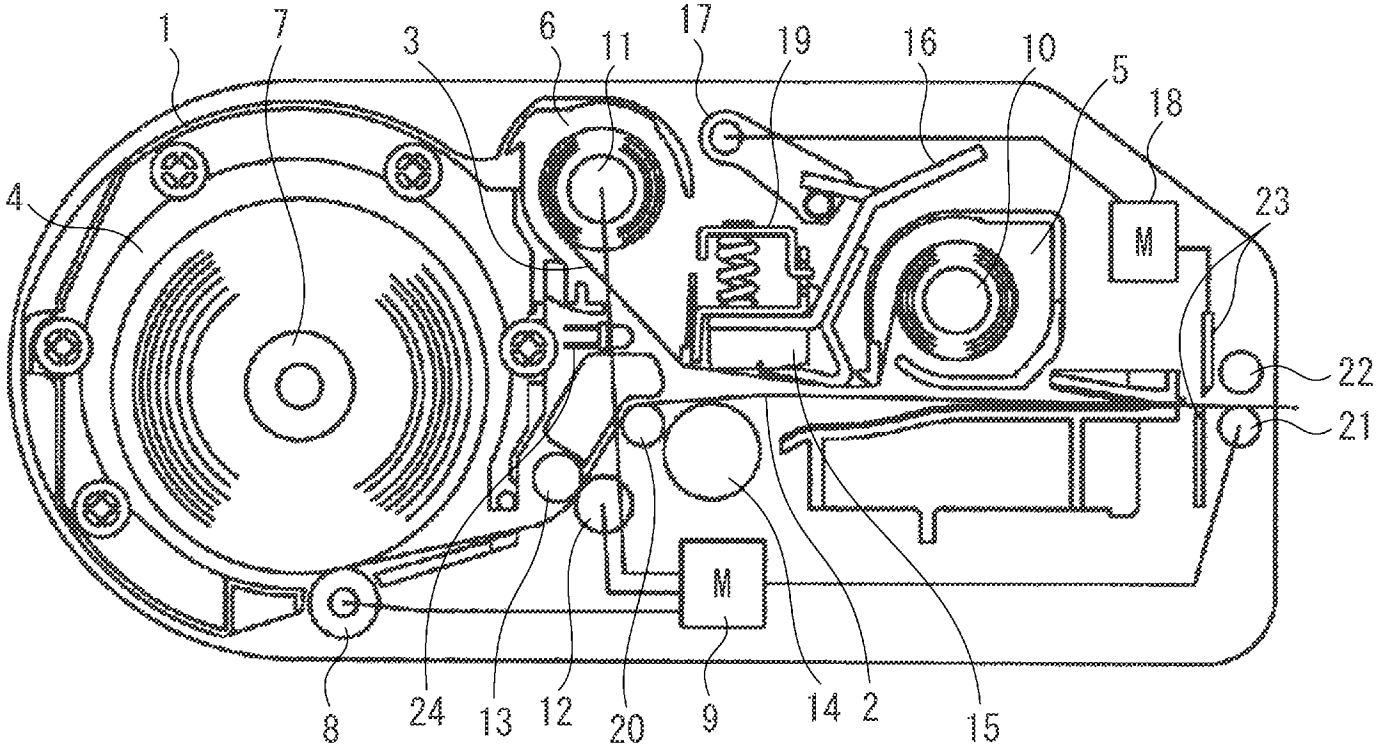
FIG. 1 is a cross-sectional schematic view of a printing apparatus according to an exemplary embodiment of the present invention.

FIG. 1 is a cross-sectional schematic view of a printing apparatus according to an exemplary embodiment of the present invention. A cassette 1 storing a recording sheet 2 and an ink ribbon 3 includes a roll sheet storage unit 4, a supply ribbon storage unit 5, and a take-up ribbon storage unit 6.

The roll sheet storage unit 4 stores a roll sheet around which the recording sheet 2 is wound. The supply ribbon storage unit 5 stores a pre-use ink ribbon 3, which is wound around a supply ribbon core 10. The take-up ribbon storage unit 6 stores a used ink ribbon 3, which is wound around a take-up ribbon core 11. The recording sheet 2 may be a paper sheet like printing paper, or may be a plastic sheet like an overhead projector (OHP) sheet, for example.

A roll sheet core 7 is inserted in a hole section in the middle of the roll sheet. During a recording operation, a not-illustrated roll sheet pressing mechanism urges the roll sheet core 7 toward a feed roller 8.

The feed roller 8 is connected to a conveyance motor 9 via a not-illustrated drive system. The feed roller 8 is capable of rotating based on the drive of the conveyance motor 9. While the roll sheet is urged against the feed roller 8, when the feed roller 8 is rotated in the clockwise direction in FIG. 1, the recording sheet 2 is fed out of the roll sheet storage unit 4. When the feed roller 8 is rotated in a counterclockwise direction, the recording sheet 2 is stored inside the roll sheet storage unit 4.

The take-up ribbon core 11 is also connected to the conveyance motor 9 via a not-illustrated drive system and a torque limiter. The take-up ribbon core 11 only rotates in the clockwise direction in FIG. 1 based on the drive of the conveyance motor 9. The ink ribbon 3 is wound based on the rotation of the take-up ribbon core 11.

A pinch roller 13 presses against a conveyance roller 12, so that the recording sheet 2, which has come between the rollers 12 and 13, can be sandwiched. The conveyance roller 12 is also connected to the conveyance motor 9 via a not-illustrated drive system. The conveyance roller 12 can rotate in both directions based on the drive of the conveyance motor 9. When the conveyance roller 12 rotates in the clockwise direction in FIG. 1, the recording sheet 2 is conveyed in a direction which pulls it out from the roll sheet storage unit 4. When the conveyance roller 12 rotates in the counterclockwise direction in FIG. 1, the recording sheet 2 is conveyed in a direction which draws it into the roll sheet storage unit 4.

The conveyance motor 9, the feed roller 8, the conveyance roller 12, the pinch roller 13, a below-described discharge roller 21, and a below-described discharge counter roller 22 constitute a conveyance mechanism for conveying the recording sheet 2 and the ink ribbon 3.

A thermal head 15 has a plurality of heating elements arranged in a line. Each of these heating elements can be made to selectively generate heat. The thermal head 15 is held in a head holding unit 16, which is movably supported on a main body frame of the printing apparatus. The thermal head 15 can be detachably mounted on the head holding unit 16.

A platen 14 is provided facing the thermal head 15. The platen 14 supports the recording sheet on a region (recording region) between the platen 14 and the thermal head 15. In the present exemplary embodiment, a roller type structure that is held in a freely rotatable manner is used as the platen 14. However, a flat type structure may also be used as the platen 14.

The head holding unit 16 is rotatably configured about a rotation axis along the surface of the recording sheet (and the ink ribbon) in the recording region. A head drive lever 17 rotatably supported by the main body frame is connected to a head drive motor 18 via a not-illustrated drive system. When the head drive lever 17 is rotated in the clockwise direction in FIG. 1 based on a drive from the head drive motor 18, the head drive lever 17 rotates the head holding unit 16 via a head pressure plate 19. Consequently, the thermal head 15 is pressed (is in a pressed state) against the platen 14. At this stage, a row along which the heating elements of the thermal head 15 are arranged matches the line where the thermal head 15 and the platen 14 are in contact.

When the head drive lever 17 is rotated in the counterclockwise direction in FIG. 1, a pin provided on the head drive lever 17 pushes the head holding unit 16 up. Consequently, the thermal head 15 is moved in a retracting direction from the platen 14 (is in a separated state). The thermal head 15 is configured so that it can move between a pressing state, in which the thermal head 15 is pressed against the platen 14, and a separated state, in which the thermal head 15 is separated from the platen 14. In addition, the thermal head 15 may be configured so that it can move to a standby state, in which it is even further separated from the platen 14 than the above separated state.

A decurling roller 20 is held at either end on the main body frame, and can freely rotate. The decurling roller 20 is arranged at the point where a recording sheet path leading from the roll sheet storage unit 4 to the conveyance roller 12 and a recording sheet path near the thermal head 15 meet. The decurling roller 20 has a function for squeezing the recording sheet 2 to remove curl that the sheet has.

A ceramic substrate provided with a plurality of heating elements in a line in an orthogonal direction to the paper surface in FIG. 1 is mounted on the thermal head 15. When the thermal head is in the pressing state, the line along which the heating elements are arranged is in contact with the platen 14.

A discharge roller 21 is connected to the conveyance motor 9 via a not-illustrated drive system. The discharge roller 21 can rotate in either direction based on a drive from the conveyance motor 9. When the discharge roller 21 is rotated in a clockwise direction or a counterclockwise direction, the discharge roller 21 conveys the recording sheet 2 in the same direction that the conveyance roller 12 conveys the recording sheet 2. A discharge counter roller 22 is held at either end by a not-illustrated holding member in a freely rotatable manner.

When the thermal head 15 is in the pressing state or in the separated state, the holding member separates the discharge counter roller 22 from the discharge roller 21. Further, when the thermal head 15 is in a retracted state, the holding member causes the discharge counter roller 22 to approach the discharge roller 21, so that the discharge counter roller 22 presses against the discharge roller 21.

A cutter 23 is connected to the head drive motor 18 via a not-illustrated drive system. The cutter 23 is operated by driving the head drive motor 18 in the opposite direction to that when the position of the thermal head 15 is moved.

The conveyance amount of the recording sheet 2 by the discharge roller 21 is set to be greater than the conveyance amount of the recording sheet 2 by the discharge roller 21. Consequently, when the recording sheet 2 is conveyed from the conveyance roller 12 toward the discharge roller 21 while being sandwiched, the recording sheet 2 between the discharge roller 21 and the conveyance roller 12 is in a taut state. Thus, by operating the cutter 23 in a state in which tension is applied to the recording sheet 2, the recording sheet 2 can be properly cut.

Figure 2:
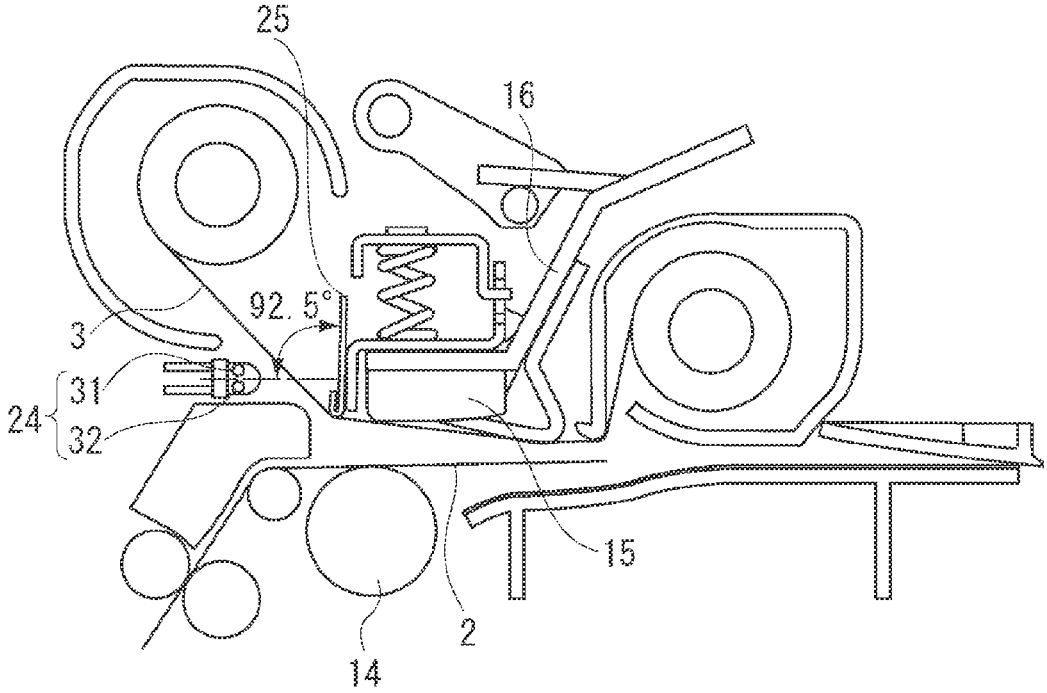
FIG. 2 is a schematic cross-sectional view of a recording region vicinity in a separated state (separated position) of the printing apparatus illustrated in FIG. 1.

FIG. 2 is a schematic cross-sectional view of a printing apparatus in the vicinity of a recording region when the thermal head 15 is in the separated state. Before recording on the recording sheet starts, in this separated state, the recording sheet 2 and the ink ribbon 3 are conveyed to a recording start position by a conveyance mechanism (preparation conveyance).

Inks (including transparent) of various colors, such as yellow, magenta, cyan, and an overcoat, are coated on the ink ribbon 3. Between adjacent ones of the transfer regions on which the various ink colors are coated, a light-impermeable marker (e.g., a black marker) is applied. This marker is used as a reference for performing head-finding of the transfer region for each color.

A ribbon sensor 24 for detecting the marker applied on the ink ribbon 3 includes a light emitting element 31 and a light receiving element 32. The light emitting element 31 may be, for example, an element which emits infrared rays. In this case, an element which receives infrared rays is used for the light receiving element 32. The marker applied on the ink ribbon 3 may be impermeable to only the light which is output by the light emitting element 31.

The printing apparatus has a peeling member 25 which acts as the starting point where the ink ribbon 3, which has passed a region (recording region) for thermal transfer of the ink applied on the ink ribbon 3 onto the recording sheet 2, and the recording sheet 2 are pulled away from each other. In the present exemplary embodiment, at least a part of the peeling member 25 serves as a reflection surface 33. The peeling member 25 is formed a metal plate folded into two.

The reflection surface 33 is configured so as to allow incident light from the light emitting element 31 of the ribbon sensor 24 to reach the light receiving element 32 of the ribbon sensor 24. When the thermal head 15 is in the separated state, the angle between the center beam of the light output from the light emitting element 31 (hereinafter, "light emitting element optical axis") and the reflection surface 33 is, for example, 92.5°.

The ribbon sensor 24 is provided on the opposite side to the reflection surface 33, sandwiching the path of the ink ribbon 3 from which the recording sheet 2 has been pulled away after passing through the recording region.

Figure 3:
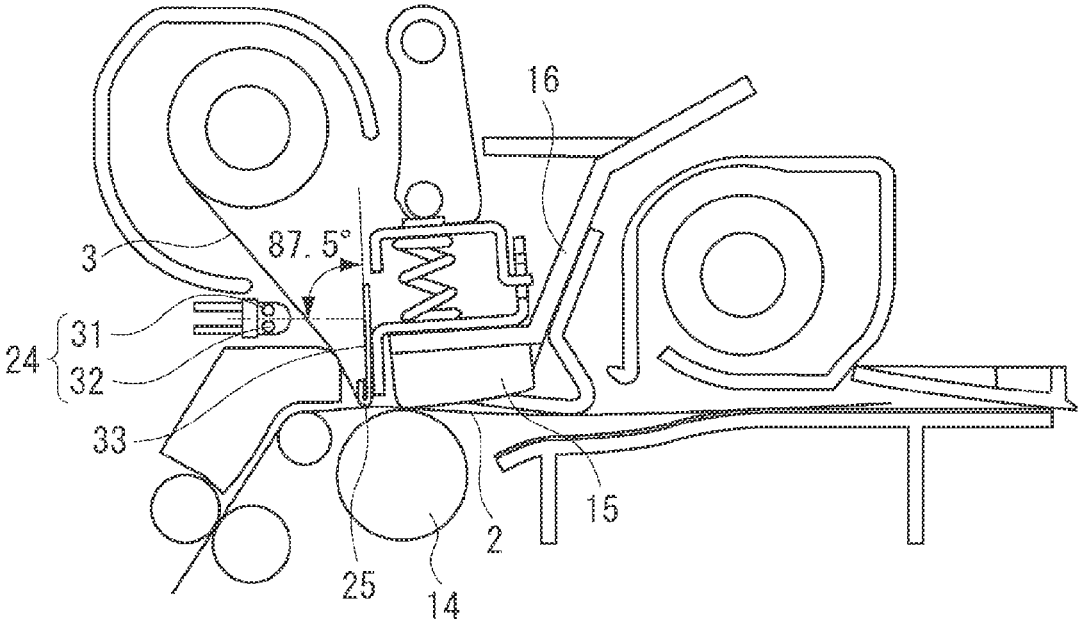
FIG. 3 is a schematic cross-sectional view of a recording region vicinity of a printing apparatus in a pressing state (pressing position) according to an exemplary embodiment of the present invention.

FIG. 3 is a schematic cross-sectional view illustrating a recording region vicinity of a printing apparatus when the thermal head 15 is in the pressing state. In the pressing state, the recording operation for transferring the ink on the ink ribbon 3 onto the recording sheet is performed.

In the recording operation, the conveyance mechanism conveys the recording sheet 2 and the ink ribbon 3, which are put on each other, between the thermal head 15 and the platen 14. Along with this, the thermal head 15 selectively causes each heating element to generate heat based on an input predetermined image. Consequently, a desired single-color image coated on the ink ribbon is transferred onto the recording sheet 2. A desired full color image can be formed on the recording sheet 2 by repeating this recording operation for the three ink colors of yellow, magenta, and cyan. After the full color image is formed, an overcoat coated on the ink ribbon 3 may also be transferred onto the recording sheet 2 by a similar recording operation.

In the pressing state, the reflection surface 33 is inclined by 2.5° in the direction of the ribbon sensor 24 from the plane orthogonal to the optical axis of the light emitting element 31 of the ribbon sensor 24. More specifically, in the pressing state, the angle between the center beam of the light output from the light emitting element 31 and the reflection surface 33 is, for example, 87.5°.

The light emitting element 31 of the ribbon sensor 24 can have a directional characteristic for outputting light having an intensity of 90% or more in an angular direction of within 10° from the optical axis of the light emitting element. Further, the light receiving element 32 of the ribbon sensor 24 can have a directional sensitivity characteristic of 90% or more in an angular direction of within 10° from the optical axis of the light receiving element. Consequently, the marker on the ink ribbon can be detected without any problems even if the reflection surface 33 is inclined respectively ±2.5° from the plane orthogonal to the optical axis of the light emitting element and the light receiving element.

Figure 4:
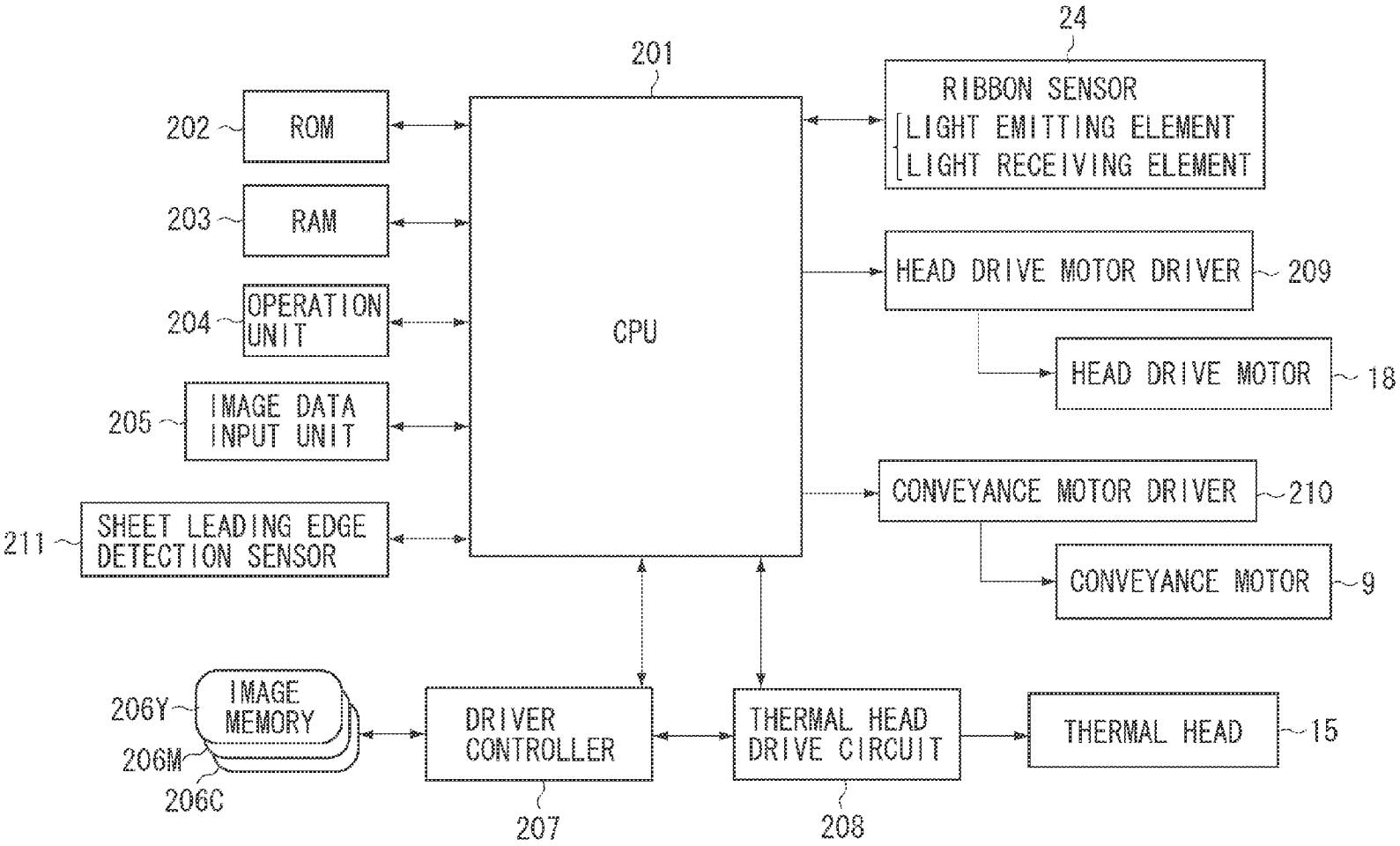
FIG. 4 is a block diagram illustrating an electrical configuration of a printing apparatus according to an exemplary embodiment of the present invention.

FIG. 4 is a block diagram illustrating an electrical configuration of the printing apparatus according to the present exemplary embodiment. A central processing unit (CPU) 201 controls the whole printing apparatus. A read-only memory (ROM) 202 is connected to the CPU 201, and stores a control program and the like. The CPU 201 is operated based on the control program stored in the ROM 202. A random access memory (RAM) 203 is used as a work memory for arithmetic processing for the CPU 201. The RAM 203 also temporarily stores various setting data input via an operation unit 204.

Image buffers 206Y, 206M, and 206C store image data received via an image data input unit 205. The yellow image buffer 206Y temporarily stores yellow image data, the magenta image buffer 206M temporarily stores magenta image data, and the cyan image buffer 206C temporarily stores cyan image data.

A thermal head drive circuit 208 drives a heating element (not-illustrated) provided in the thermal head 15. A driver controller 207 connected to the CPU 201 controls the thermal head drive circuit 208 using the image data received in the image buffers 206Y, 206M, and 206C. The recording operation is thus performed.

The ribbon sensor 24 detects a marker on the ink ribbon based on the amount of light emitted from the light emitting element 31 which is received by the light receiving element 32 during a head-finding operation for the ink ribbon.

A sheet leading edge detection sensor 211, which is provided near the conveyance roller 12 above the sheet conveyance path, is a photosensor capable of detecting the presence of the recording sheet 2.

A head drive motor driver 209 for driving the head drive motor 18 drives the head drive motor 18 to move the thermal head 15 to any of the pressing state, the separated state, and the retracted state.

A conveyance motor driver 210 for driving the conveyance motor 9 drives the conveyance motor 9 to convey the recording sheet 2 by only a desired amount. Further, the conveyance motor driver 210 also winds the ink ribbon 3 by driving the conveyance motor 9. However, the conveyance motor driver 210 cannot grasp the conveyance amount of the ink ribbon 3. Therefore, the marker applied on the ink ribbon is detected by the ribbon sensor 24 to specify the conveyance amount of the ink ribbon. Consequently, this enables head-finding for the ink ribbon of the transfer region on which the inks of various color are coated to be performed.

Figure 5:
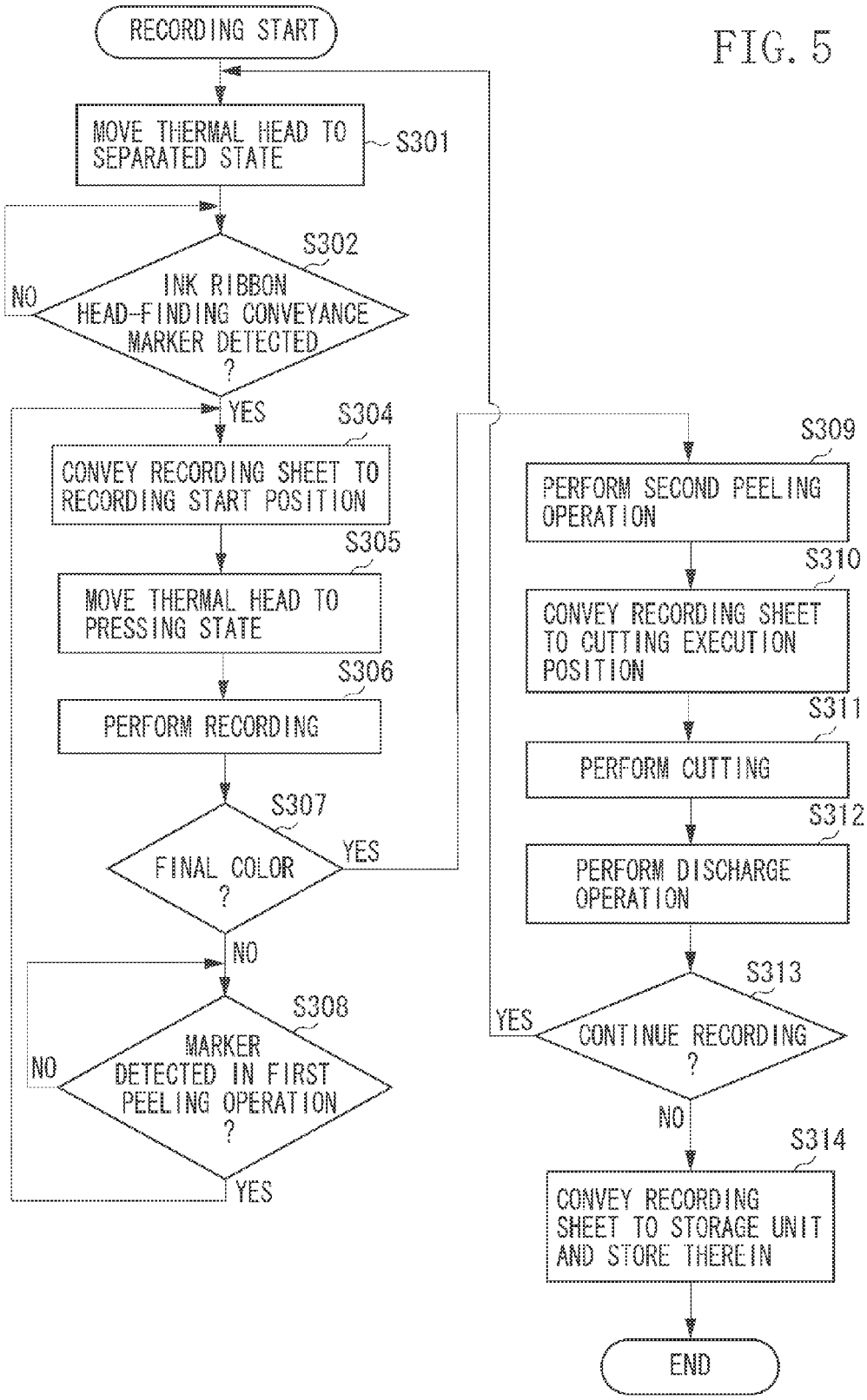
FIG. 5 is a flowchart illustrating a flow of a printing operation according to an exemplary embodiment of the present invention.

Next, the flow of the recording operation according to the present exemplary embodiment will be described using the flowchart illustrated in FIG. 5. The printing apparatus operates based on the flow illustrated in FIG. 5 when a user loads the cassette 1 into the printing apparatus main body, selects the image which the user wishes to output from among the image data input from the image data input unit 205 by the operation unit 204, and executes a recording operation.

In step S301, the head drive lever 17 is rotated by rotation of the head drive motor 18 so that the thermal head 15 is in the separated state illustrated in FIG. 3.

Next, in step S302, head-finding conveyance of the ink ribbon is performed. At this stage, by driving the conveyance motor 9, the take-up ribbon core 11 is made to rotate in the clockwise direction in FIG. 3 to start winding conveyance of the ink ribbon. At this stage, since the conveyance roller 12 also rotates, if the conveyance roller 12 is sandwiching the recording sheet 2, the recording sheet 2 is also conveyed toward the roll sheet storage unit 4.

In step S302, along with the winding conveyance of the ink ribbon, detection of the ink ribbon marker is also started. In the separated state illustrated in FIG. 3, the light emitted from the light emitting element 31 of the ribbon sensor 24 passes through the ink ribbon 3, is reflected by the reflection surface 33, and reaches the light receiving element 32 of the ribbon sensor 24.

When a head-finding marker, which is applied on the ink ribbon 3 and which corresponds to each color, covers the light path of the light output from the ribbon sensor 24, the light amount of the light reaching the light receiving element 32 decreases. This decrease in the light amount is used as a trigger for head-finding completion, and the drive of the conveyance motor 9 is stopped. At this stage, the transfer region of each color on the ink ribbon is positioned at the location where the heating element of the thermal head is provided.

In the present exemplary embodiment, since the peeling member 25 is attached to the head holding unit 16, the recording sheet 2 and the ink ribbon 3 are peeled apart near the recording region. Further, since a part of the peeling member 25 acts as the reflection surface 33, the distance between the position where the marker on the ink ribbon 3 is detected and the position where the heating element of the thermal head 15 is detected is short. Consequently, an increase in the margin from the marker position on the ink ribbon to the leading edge of the next color ink can be reduced.

For an ink ribbon head-finding conveyance operation performed immediately after an instruction to execute recording is input, conveyance of the ink ribbon is stopped when a double-line marker coated on the head of the transfer region of the first color (e.g., yellow) is detected. On the other hand, when performing head-finding of the transfer regions for other colors, conveyance of the ink ribbon is stopped when a single-line marker is detected.

Next, in step S304, the conveyance motor 9 is rotated in the opposite direction to that during the ink ribbon head-finding operation (step S302), to convey the recording sheet 2 from the roll sheet storage unit 4 in the feeding direction. Then, the recording sheet 2 is conveyed to the recording start position. At this stage, the take-up ribbon core 11 is disengaged by a planetary switching mechanism provided in the drive system up to the conveyance motor 9, so that the take-up ribbon core 11 does not rotate.

During conveyance of the recording sheet immediately after the user inputs an instruction to execute recording, first, the recording sheet 2 is fed from within the roll sheet storage unit 4 by a drive from the feed roller 8.

The fed recording sheet 2 enters between the conveyance roller 12 and the pinch roller 13, so that the recording sheet 2 is sandwiched by the pair of rollers. Subsequent sheet conveyance is mainly performed by this pair of rollers. Until recording is completed, the recording sheet 2 is maintained in a sate sandwiched by this pair of rollers.

After the recording sheet 2 is sandwiched by this pair of rollers, the recording sheet 2 is further conveyed in the same direction, and the leading edge of the recording sheet 2 passes the sheet leading edge detection sensor 211. Based on the position of the recording sheet 2 at this time as a base point, the subsequent conveyance distance of the recording sheet can be calculated by counting the number of drive steps of the conveyance motor 9.

When the recording sheet reaches the peeling starting point, the recording sheet 2 is further conveyed in the same direction, and the recording sheet 2 passes the recording region between the platen 14 and the thermal head 15. Subsequently, the recording sheet 2 is conveyed to a position (recording start position) in which the distance from the leading edge in the conveyance direction of the recording sheet 2 to the location where the heating element of the thermal head 15 is arranged corresponds to the length of the recording image. Driving of the conveyance motor 9 is then stopped, and the conveyance operation is completed.

On the other hand, for conveyance of the recording sheet during recording operations other than immediately after the user has input an instruction to execute recording, the recording sheet is already sandwiched between the conveyance roller 12 and the pinch roller 13. Therefore, with the base point of the conveyance of the recording sheet serving as a reference, the conveyance motor 9 is driven only the distance that is necessary for the recording sheet 2 to move to the recording start position, and the conveyance operation is completed.

Next, in step S305, the head drive lever 17 is rotated by rotating the head drive motor 18, so that the thermal head 15 moves to the pressing state illustrated in FIG. 1.

Next, in step S306, the recording operation is started. The thermal head 15 is pressing against the platen 14 (is in the pressing state), and the heating element on the thermal head 15 in the pressing state is selectively caused to generate heat based on an input from the thermal head drive circuit 208. Along with this, the conveyance motor 9 is driven so that the conveyance roller 12 is rotated in the direction for storing the recording sheet 2 in the roll sheet storage unit 4, and the take-up ribbon core 11 is rotated in the direction for winding the ink ribbon 3.

If the ink ribbon 3 and the recording sheet 2 are not closely adhered, the drive system from the conveyance motor 9 to the conveyance roller 12 and the drive system from the conveyance motor 9 to the take-up ribbon core 11 are set so that the conveyance speed of the ink ribbon 3 is faster than the conveyance speed of the recording sheet 2. However, in the pressing state, since the recording sheet 2 and the ink ribbon 3 are being pressed and sandwiched against each other in a superimposed state by the thermal head 15 and the platen 14, the conveyance speed of the ink ribbon 3 is the same as the conveyance speed of the recording sheet 2. Therefore, the above-described speed difference is absorbed by providing a torque limiter in the drive system up to the take-up ribbon core 11.

Thus, the thermal head 15 and the conveyance motor 9 are simultaneously driven, and based on the amount of heat generated by the heating element, the ink coated on the ink ribbon 3 is transferred onto the recording sheet 2, so that an image is formed on the recording sheet 2. This operation is performed for only the number of lines of the input image. Then, driving of the thermal head 15 and the conveyance motor 9 is stopped, and the recording operation is completed.

Next, in step S307, it is determined whether the previous recording operation is the ink for the final color (the color which should be transferred last onto the recording sheet). If the previous recording operation is the ink (in the present exemplary embodiment, the overcoat) for the final color (YES in step S307), the processing proceeds to step S309. In step S309, a second peeling operation is performed. If the previous recording operation is not the ink for the final color (NO in step S307), the processing proceeds to step S308. In step S308, a first peeling operation is performed.

When the recording operation (step S306) is completed, the recording sheet 2 and the ink ribbon 3 positioned in the space from the heating element of the thermal head 15 to the peeling member 25 are stuck to each other as a consequence of the recording operation. In the first and second peeling operations (steps S308 and S309), the recording sheet 2 and the ink ribbon 3 are peeled from each other.

In the first peeling operation performed in step S308, the marker on the ink ribbon is detected by the ribbon sensor 24, and the conveyance motor 9 and the head drive motor 18 are driven.

The conveyance motor 9 is driven in the same direction as in the recording operation (step S306). Consequently, the recording sheet 2 is conveyed in a direction for storing it in the roll sheet storage unit 4, and the ink ribbon 3 is conveyed in a winding direction.

On the other hand, the head drive motor 18 is driven so that the thermal head 15 is in the separated state. Since the thermal head 15 is separated from the platen 14, the ink ribbon 3 is released from the pressed state. Consequently, the ink ribbon 3 is conveyed faster than the recording sheet 2, which allows the ink ribbon 3 to be peeled from the recording sheet 2 faster and more actively. Therefore, there is the advantage that a peeling trace is not easily roughened.

The operation for detecting the marker on the ink ribbon by the ribbon sensor 24 may be started once the thermal head 15 is in the pressing state. Alternatively, the operation for detecting the marker on the ink ribbon by the ribbon sensor 24 may be controlled so that it starts after the ink has been transferred from the ink ribbon onto the recording sheet, during the period in which the state changes from the pressing state to the separated state. In this case, the ribbon sensor 24 can detect the marker on the ink ribbon while the thermal head 15 is moving to the separated state.

Based on this operation, the margin between the trailing edge of the transfer region for each color on the ink ribbon 3 and the leading edge of the marker provided on the head of the next color ink can be reduced or eliminated. This is because, during the peeling operation, specifically, during movement of the thermal head 15, marker detection can be constantly performed, and the marker never goes past the light path of the light from the ribbon sensor 24 before the detection operation is performed.

Thus, since the margin on the ink ribbon 3 is reduced or eliminated, the total length of the ink ribbon can be shortened. This leads to further advantages such as a reduction in the size of the ink ribbon cassette and reduction in costs. In addition, by reducing or eliminating the margin on the ink ribbon, the conveyance time for the ink ribbon is also decreased, and the time taken for recording is shortened. Consequently, the risk of slippage and wrinkles being produced on the ink ribbon is reduced.

Further, since the light from the ribbon sensor 24 is reflected by the reflection surface 33 on a metal plate, there is less risk that the light path of the reflected light will diffuse. Consequently, compared with Japanese Patent Application Laid-Open No. 2006-159432, in which the light is reflected by the printing paper, the marker on the ink ribbon 3 can be more stably detected.

The head drive motor 18 is stopped when the thermal head 15 moves to the separated state. On the other hand, the conveyance motor 9 is stopped when the ribbon sensor 24 detects the marker on the ink ribbon 3. The fact that a marker has been detected by the ribbon sensor 24 means that the ink ribbon portion that is stuck to the recording sheet when the recording operation (step S306) is completed has passed the ribbon sensor 24, and that portion has reliably peeled away from the recording sheet. The first peeling operation (step S308) is completed when the driving of the motors 9 and 18 is finished.

In the present exemplary embodiment, in the pressing state illustrated in FIG. 1, the light emitted from the light emitting element of the ribbon sensor 24 is reflected by the reflection surface 33, and reaches the light receiving element of the ribbon sensor 24. In addition, in the separated state illustrated in FIG. 3 too, the light emitted from the light emitting element of the ribbon sensor 24 is reflected by the reflection surface 33, and reaches the light receiving element of the ribbon sensor 24.

In the pressing state, the reflection surface is inclined by −2.5° with respect to the plane orthogonal to the light projection direction (direction along the optical axis) of the ribbon sensor 24. Further, in the separated state, the reflection surface is inclined by +2.5° with respect to the plane orthogonal to the light projection direction (direction along the optical axis) of the ribbon sensor 24. Moreover, during switching between these two states, the optical axis of the ribbon sensor 24 and the reflection surface 33 are orthogonal to each other.

Thus, along with the movement of the thermal head 15, the reflection surface 33 is slightly inclined in either direction with respect to the plane perpendicular to the optical axis of the ribbon sensor 24 as a reference. According to the above configuration, while the thermal head 15 is moving from the pressing state to the separated state, the light from the light emitting element 31 is reflected by the reflection surface 33 and reaches the light receiving element 32. Therefore, while moving from the pressing state to the separated state, the marker on the ink ribbon 3 can be detected by the ribbon sensor 24.

When the first peeling operation (step S308) is completed, the processing returns to step S304. Here, in step S304, the recording sheet 2 is again conveyed to the recording start position. Then, in step S305, the position of the thermal head 15 is changed to the pressing state. Next, in step S306, the above-described recording operation up to the ink of the final color being transferred is repeated.

Next, the second peeling operation (step S309) will be described. In step S309, the simultaneous driving of the conveyance motor 9 and the head drive motor 18 is similar to the first peeling operation (step S308). However, in the second peeling operation, detection of a marker by the ribbon sensor 24 is not performed.

Similar to the first peeling operation (step S308), the head drive motor 18 is stopped when the thermal head 15 moves to the separated state. On the other hand, the conveyance motor 9 is stopped after it is driven just the number of steps corresponding to driving the recording sheet 2 just the distance from the position of the heating element of the thermal head 15 to the peeling member 25. By doing this, after the recording operation is completed in step S306, the region where the recording sheet 2 and the ink ribbon 3 are stuck to each other passes the peeling member 25. Consequently, the recording sheet 2 and the ink ribbon 3 are peeled from each other.

Figure 11:
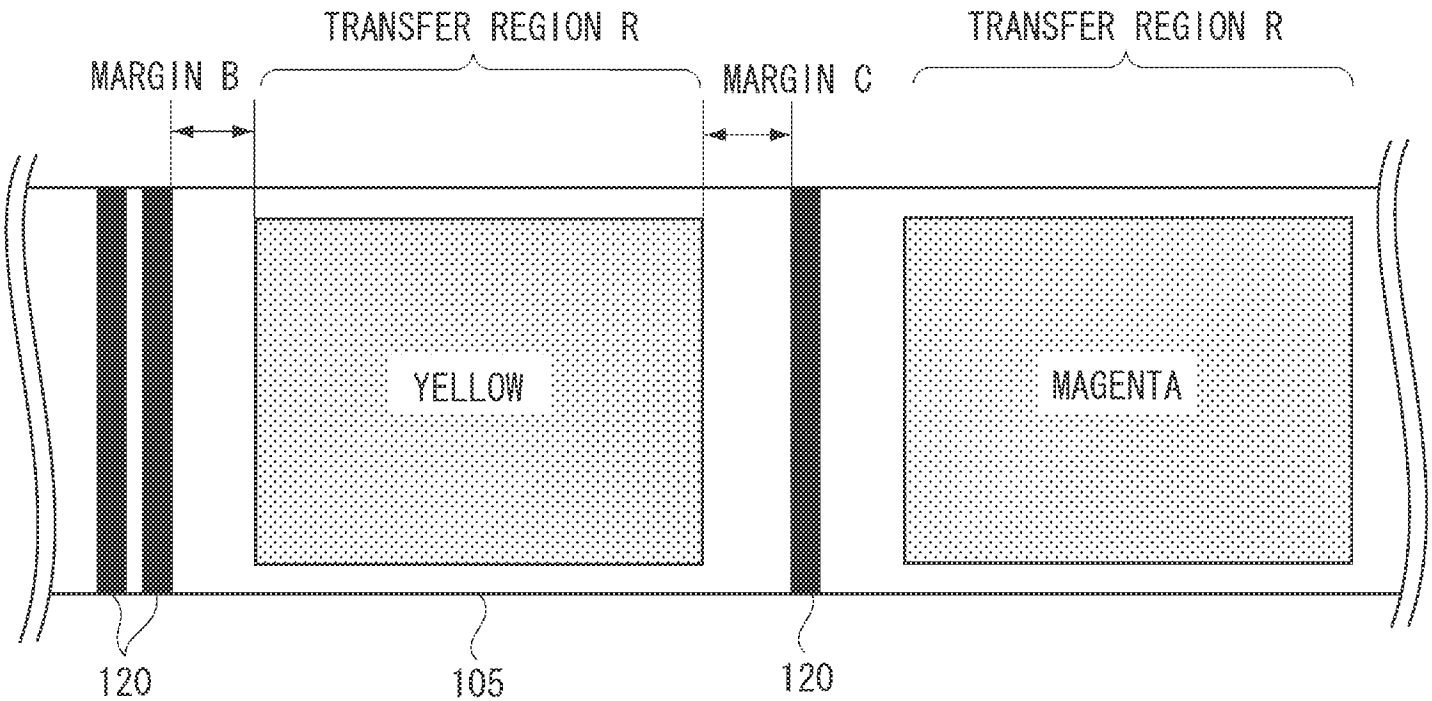
FIG. 11 PRIOR ART
FIG. 11 is a schematic plan view illustrating a marker and a transfer region applied on an ink ribbon used in a conventional thermal printer.

As described above, in the first peeling operation, detection of a marker on the ink ribbon is performed along with performing the peeling operation. Therefore, the margin (margin C illustrated in FIG. 11) between the trailing edge of the transfer region and the marker provided at the head of the next color ink can be reduced or eliminated.

In the second peeling operation, similar to the conventional art, only a peeling operation is performed. After the ink ribbon 3 is peeled from the recording sheet 2, the marker on the ink ribbon is detected. When the second peeling operation is completed, in step S310, the recording sheet 2 is conveyed to the execution position for a cutting operation. The conveyance motor 9 is driven in the opposite direction to that during the recording operation, and the recording sheet 2 is conveyed so that the writing position of the image on the recording sheet 2 is at a position immediately below the cutter 23.

During conveyance, when the leading edge of the recording sheet 2 passes above the discharge roller 21, the head drive motor 18 is driven to move the thermal head 15 to a standby state. Then, the discharge counter roller 22 is pressed against the discharge roller 21. Consequently, as described above, when the recording sheet 2 is finished being conveyed to the cutting operation execution position, the recording sheet 2 is in a taut state between the conveyance roller 12 and the discharge roller 21.

Next, in step S311, the cutting operation is performed. Specifically, the head drive motor 18 is driven in the opposite direction from that when switching the state of the thermal head 15, and the cutter 23 is operated. Consequently, the recording sheet 2 is cut at the writing position of the image formed on the recording sheet 2.

Next, a discharge operation of the recording sheet cut in step S312 is performed. Specifically, the conveyance motor 9 is driven in the opposite direction from that in the recording operation (step S306), the recording sheet is conveyed until the cut recording sheet exits from between the discharge roller 21 and the discharge counter roller 22, and the recording sheet is discharged out of the printer main body.

Next, in step S313, a check is performed as to whether an instruction to execute recording for the next image has been input. If an instruction to execute recording for the next image has been input (YES in step S313), the thermal head 15 is returned to the separated state (step S301), and the series of operations is again executed. If an instruction to execute recording for the next image has not been input (NO in step S313), the processing proceeds to step S314. In step S314, the recording sheet 2 is stored in the roll sheet storage unit 4.

During the storing conveyance of the recording sheet 2, the conveyance motor 9 is driven in the same direction as during the recording operation (step S306), and the recording sheet 2 is conveyed in the direction for storing it in the roll sheet storage unit 4. The conveyance motor 9 is driven for just the number of steps corresponding to the conveyance amount just required for the leading edge of the recording sheet 2 to pass above the conveyance roller 12, then pass above the feed roller 8, and be stored in the roll sheet storage unit 4, so that storing conveyance is completed. Based on the above, the series of recording operations is completed.

Figure 6:
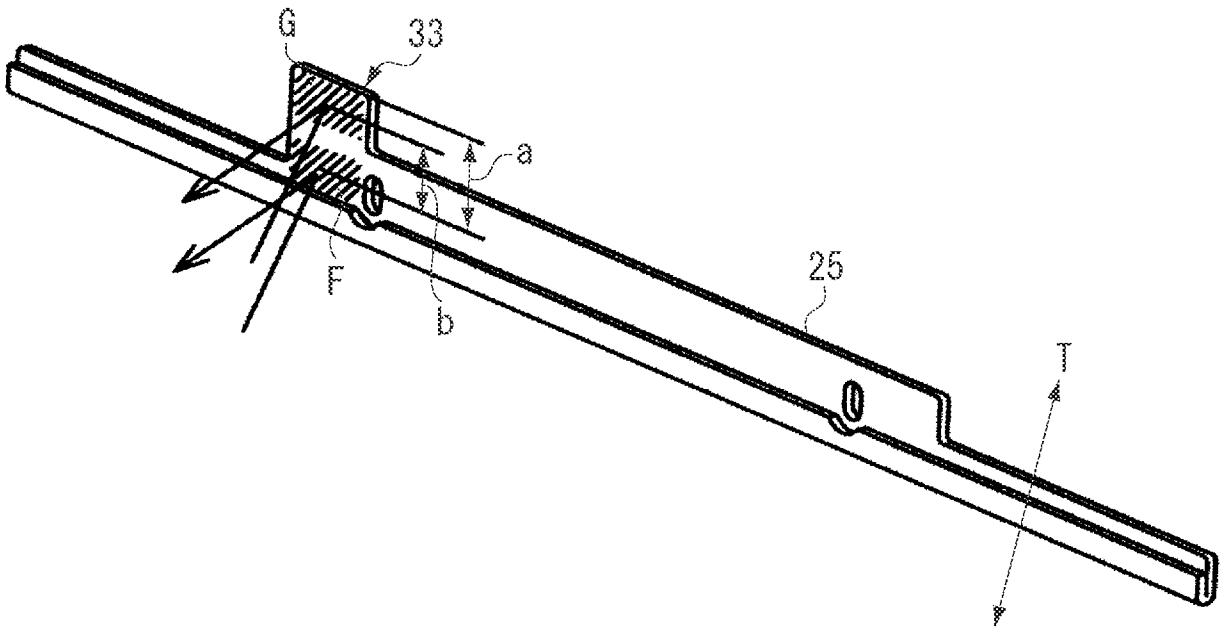
FIG. 6 is a schematic perspective view illustrating a configuration of a peeling member and a refection plate according to an exemplary embodiment of the present invention.
Figure 7:
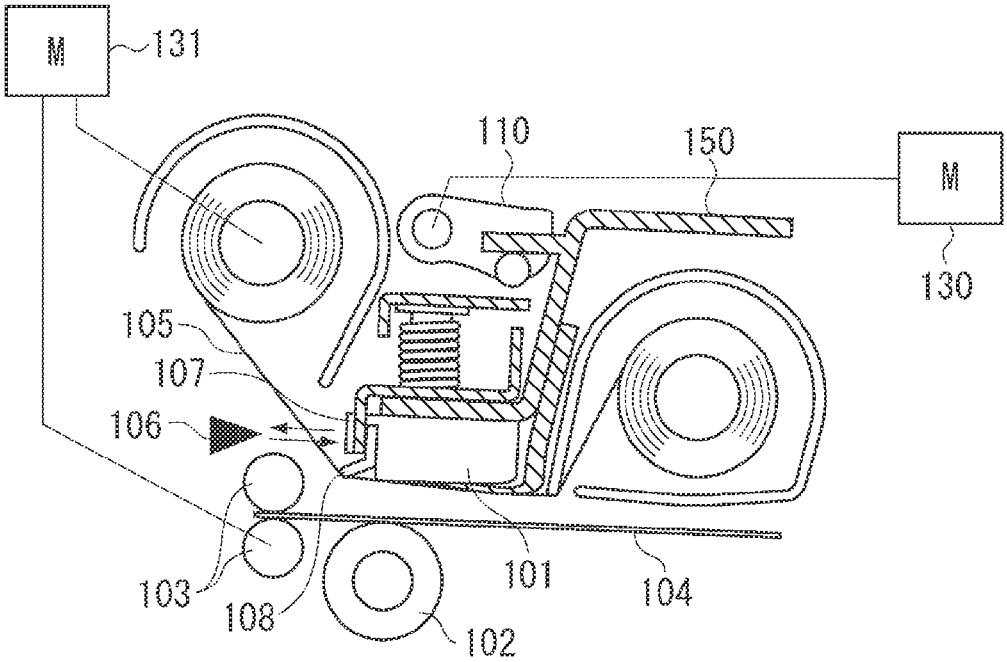
FIG. 7 PRIOR ART
FIG. 7 is a cross-sectional schematic view of a printing mechanism unit in a separated state of a conventional thermal printer.
Figure 8:
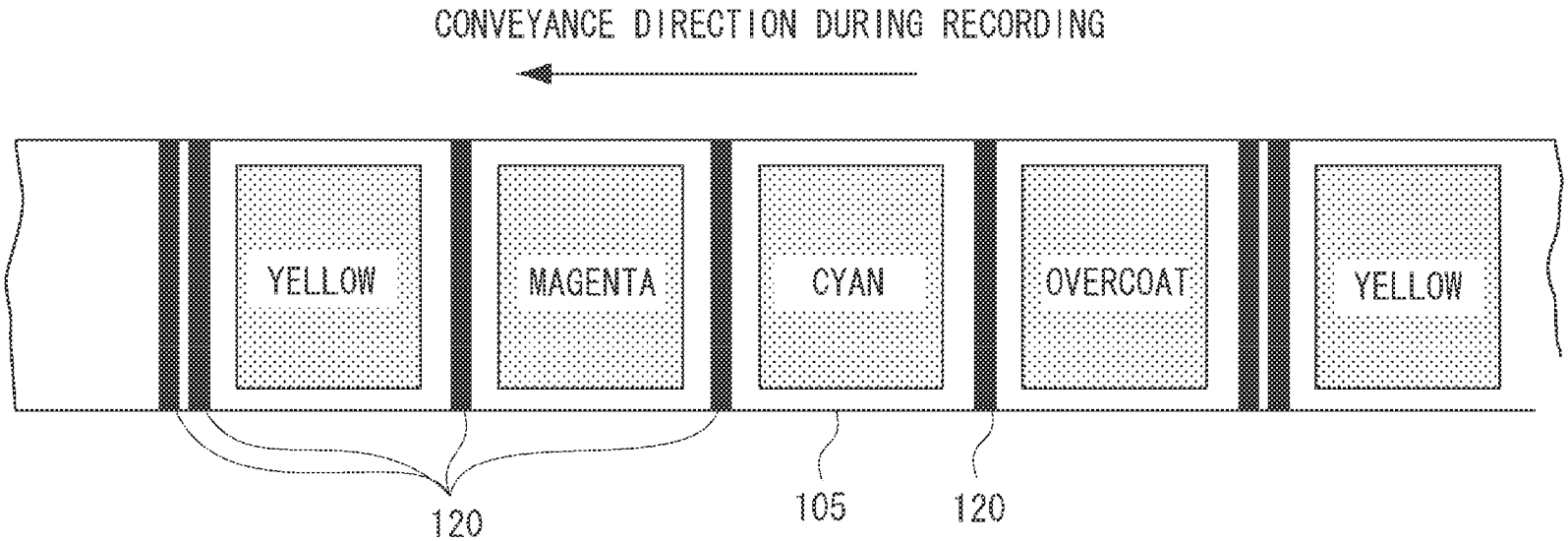
FIG. 8 PRIOR ART
FIG. 8 is a schematic plan view illustrating a region of a conventional ink ribbon.
Figure 9:
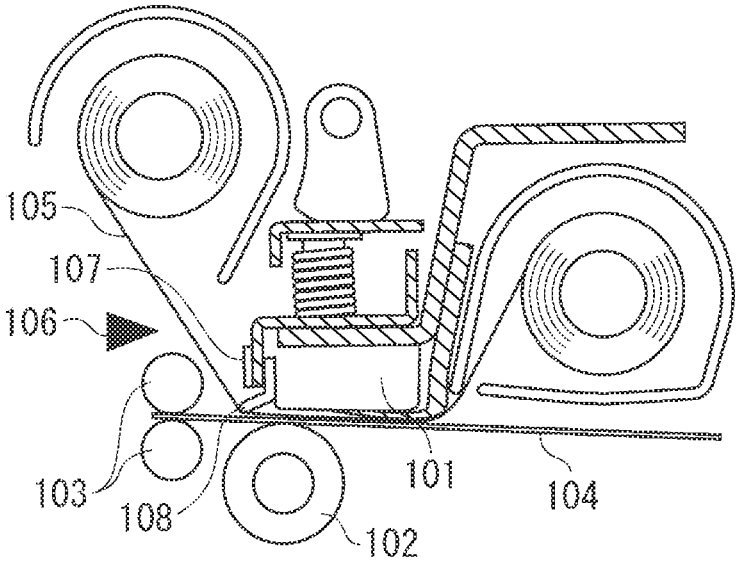
FIG. 9 PRIOR ART
FIG. 9 is a cross-sectional schematic view of a printing mechanism unit in a pressing state of a conventional thermal printer.
Figure 10:
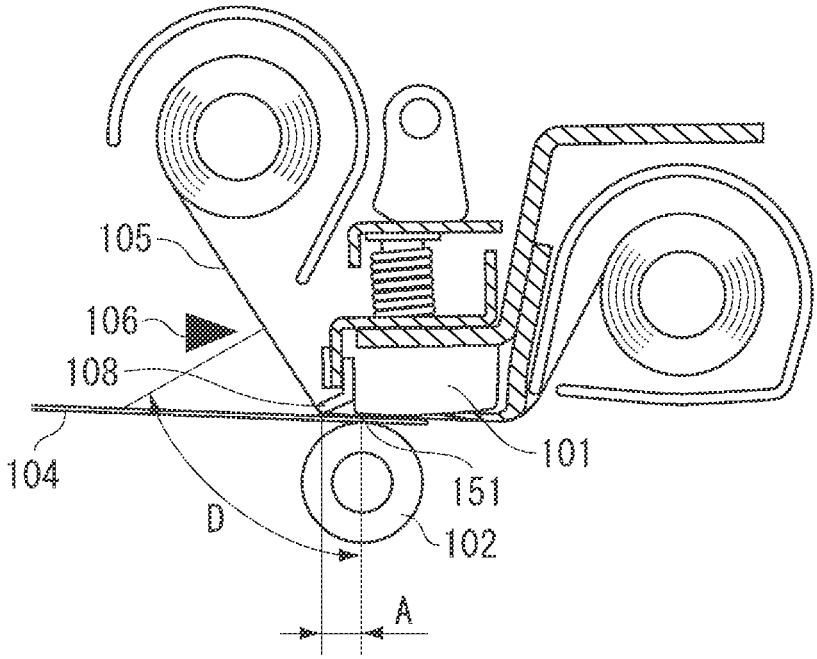
FIG. 10 PRIOR ART
FIG. 10 is a cross-sectional schematic view of a printing mechanism unit illustrating a state during a period when a printing operation is completed for a conventional thermal printer.

The peeling member 25 and the reflection surface 33 will now be described in more detail. FIG. 6 is a perspective view of the peeling member 25. The peeling member 25 is formed by folding a metal plate into two by hemming.

A curved surface portion of the hemming portion of the peeling member 25 is utilized as a starting point for peeling the recording sheet 2 and the ink ribbon 3 from each other. Therefore, the peeling member 25 has a configuration in which that curved surface and a flat portion for attaching the peeling member to the head holding unit 16 are joined.

One of the flat portions of the curved metal plate is attached to the head holding unit 16. The reflection surface 33 is provided on this flat portion of the curved metal plate. The region F in FIG. 6 is a region on the reflection surface 33 where, in the separated state, the light output from the light emitting element 31 of the ribbon sensor is reflected. The region G in FIG. 6 is a region on the reflection surface 33 where, in the pressing state, the light output from the light emitting element 31 of the ribbon sensor is reflected.

In the present exemplary embodiment, a part of the flat portion of the peeling member 25 is made to protrude in a movement direction T of the head holding unit 16 so that the marker on the ink ribbon can be detected in not only the separated state, but in the pressing state as well. This protruding region G is utilized as the reflection surface 33.

Although the whole peeling member may be extended in the movement direction T of the head holding unit 16, by making only the portion that will be utilized as the reflection surface 33 protrude in the movement direction T, the volume and the cost of the peeling member 25 can be reduced.

The length ("a" in FIG. 6) from the point where the center beam of the light output from the light emitting element 31 reaches the reflection surface 33 in the separated state to the leading edge of the reflection surface with respect to the movement direction T of the head holding unit 16 is greater than the displacement amount ("b" in FIG. 6) of the reflection surface 33 when moving from the separated state to the pressing state. More specifically, it is desirable that the length of the reflection surface 33 with respect to the movement direction T of the head holding unit 16 is greater than the displacement amount of the reflection surface 33 when moving from the separated state to the pressing state. Consequently, in both the separated state and the pressing state, the light output from the light emitting element 31 of the ribbon sensor can reach the light receiving element 32.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-266114 filed Nov. 24, 2009, which is hereby incorporated by reference herein in its entirety.

What is claimed is:

1. A printing apparatus comprising:

a head holding unit movably configured to hold a thermal head so that the thermal head can be in a pressing state pressing against a platen and in a separated state separated from the platen;

a conveyance mechanism configured to convey an ink ribbon and a recording sheet which are put on each other to a recording region between the thermal head and the platen;

a reflection surface provided on the head holding unit; and a ribbon sensor configured to detect a marker applied on the ink ribbon, the ribbon sensor being provided on a side opposite to the reflection surface and facing a path of the ink ribbon which has passed through the recording region and been peeled from the recording sheet, wherein the ribbon sensor includes a light emitting element and a light receiving element, and wherein the reflection surface is configured so that light incident from the light emitting element reaches the light receiving element in both the separated state and the pressing state.

2. The printing apparatus according to claim 1, further comprising a control unit configured to start detection of the marker by the ribbon sensor, after an ink is transferred onto the recording sheet from the ink ribbon in the pressing state, while the thermal head is moving from the pressing state to the separated state.

3. The printing apparatus according to claim 1, further comprising a control unit configured to start detection of the marker by the ribbon sensor before movement to a separated position for holding the thermal head in the separated state is completed.

4. The printing apparatus according to claim 1, further comprising a peeling member, having the reflection surface on apart thereof, configured to act as a starting point for peeling the ink ribbon from the recording sheet in the pressing state, wherein the peeling member is attached to the head holding unit.

5. The printing apparatus according to claim 4, wherein the peeling member is formed from a metal plate folded in at least two, wherein a flat portion of the folded metal plate is attached to the head holding unit, wherein the reflection surface is provided on the flat portion of the metal plate, and wherein a curved portion of the metal plate formed in a folded manner acts as a starting point for peeling of the ink ribbon and the recording sheet in the pressing state.

6. The printing apparatus according to claim 4, wherein the reflection surface provided on the peeling member widens in a movement direction of the head holding unit.

7. The printing apparatus according to claim 6, wherein the reflection surface, which is apart of the head holding unit, is configured to protrude in a movement direction of the head holding unit more than other portions of the head holding unit.

8. The printing apparatus according to claim 1, wherein a length of the reflection surface in a movement direction of the head holding unit is greater than a displacement amount of the reflection surface when moving from the separated state to the pressing state.

9. The printing apparatus according to claim 1, wherein the head holding unit is rotatably configured about a rotation axis along a surface of the ink ribbon so that the thermal head can be in the pressing state and in the separated state.

10. The printing apparatus according to claim 9, wherein an optical axis of the light emitting element and the reflection surface are orthogonal to each other in a state between the separated state and the pressing state.

11. A method for controlling a printing apparatus, the printing apparatus including a platen, a head holding unit movably configured to hold a thermal head so that the thermal head can be in a pressing state pressing against the platen and in a separated state separated from the platen, a conveyance mechanism configured to convey an ink ribbon and a recording sheet which are put on each other to a recording region between the thermal head and the platen, a reflection surface provided on the head holding unit, and a ribbon sensor having a light emitting element and a light receiving element for detecting a marker applied on the ink ribbon, the ribbon sensor being provided on a side opposite to the reflection surface and facing a path of the ink ribbon which has passed through the recording region and been peeled from the recording sheet, the method comprising:

transferring an ink onto the recording sheet from the ink ribbon in the pressing state; and after transfer of the ink, starting detection of the marker by the ribbon sensor while the thermal head is moving from the pressing state to the separated state.

* * * * *